US006789619B2

(12) United States Patent
Carlson et al.

(10) Patent No.: US 6,789,619 B2
(45) Date of Patent: Sep. 14, 2004

(54) APPARATUS AND METHOD FOR DETECTING THE LAUNCH OF A DEVICE IN OILFIELD APPLICATIONS

(75) Inventors: Bradley T. Carlson, Cypress, TX (US); Ronnie D. Hughes, The Woodlands, TX (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 10/154,435

(22) Filed: May 22, 2002

(65) Prior Publication Data

US 2003/0192690 A1 Oct. 16, 2003

Related U.S. Application Data

(63) Continuation-in-part of application No. 10/120,201, filed on Apr. 10, 2002.

(51) Int. Cl.[7] ..... E21B 33/16

(52) U.S. Cl. ..... 166/250.04; 166/66; 166/70; 166/177.4; 166/291

(58) Field of Search ..... 166/255.1, 250.03, 166/250.04, 250.12, 250.14, 177.4, 70, 66, 285, 291

(56) References Cited

U.S. PATENT DOCUMENTS

| | | | | |
|---|---|---|---|---|
| 2,004,606 A | | 6/1935 | Halliburton | 166/21 |
| 2,071,396 A | | 2/1937 | Engel | 12/7 |
| 2,141,370 A | | 12/1938 | Armentrout et al. | 166/1 |
| 2,161,284 A | | 6/1939 | Crowell | 166/1 |
| 2,169,356 A | | 8/1939 | Dyer | 166/1 |
| 2,217,708 A | | 10/1940 | Scaramucci | |
| 4,206,810 A | * | 6/1980 | Blackman | 166/336 |
| 4,468,967 A | * | 9/1984 | Carter, Jr. | 73/661 |
| 4,638,278 A | * | 1/1987 | Bullock | 335/207 |
| 4,928,520 A | * | 5/1990 | Barrington | 73/152.57 |
| 5,191,932 A | | 3/1993 | Seefried et al. | 166/291 |
| 5,252,918 A | * | 10/1993 | VanBerg et al. | 324/207.19 |
| 5,323,856 A | * | 6/1994 | Davis et al. | 166/253.1 |
| 5,890,538 A | | 4/1999 | Beirute et al. | 166/285 |
| 5,967,231 A | * | 10/1999 | Laurel et al. | 166/250.04 |
| 6,125,935 A | | 10/2000 | Shahin, Jr. | 166/250.14 |
| 6,244,342 B1 | | 6/2001 | Sullaway et al. | 166/285 |
| 6,302,199 B1 | | 10/2001 | Hawkins et al. | 166/70 |
| 6,401,814 B1 | | 6/2002 | Owens et al. | 166/253.1 |
| 2002/0157828 A1 | * | 10/2002 | King et al. | 166/285 |
| 2002/0174985 A1 | | 11/2002 | Vincent et al. | 166/285 |
| 2003/0029611 A1 | * | 2/2003 | Owens | 166/250.03 |
| 2003/0062155 A1 | * | 4/2003 | Summers | 166/66 |
| 2003/0192695 A1 | | 10/2003 | Dillenbeck et al. | 166/285 |

OTHER PUBLICATIONS

Model GN 201 & 202 Ball Injector; GN Machine Works; Feb. 1986.

"*Reverse Circulation of Cement on Primary Jobs Increases Cement Column Height Across Weak Formations*", Griffith, J.E., © 1993, SPE 25440, The SPE Image Library.

"*Primary Cementing by Reverse Circulation Solves Critical Problem in the North Hassi–Messaoud Field, Algeria*", Journal of Petroleum Technology, Feb. 1966.

* cited by examiner

*Primary Examiner*—Hoang Dang
(74) *Attorney, Agent, or Firm*—Howrey Simon Arnold & White, LLP

(57) ABSTRACT

A system for use in detecting the launching of a device, such as a wiper plug or a sealing ball, is described having a first component, such as a detectable object disposed within the device, and a second component, such as a sensor. The sensor may be a sensor coil, while the detectable object may be a transponder capable of emitting Radio Frequency Identification signals to the sensor to signal its arrival adjacent the sensor. The system may be used with a concrete head or with a sealing ball injector. A method of launching the devices is also disclosed.

45 Claims, 5 Drawing Sheets

APPARATUS AND METHOD FOR DETECTING THE LAUNCH OF A DEVICE IN OILFIELD APPLICATIONS

CROSS-REFERENCE TO RELATED APPLICATIONS

This application is a continuation-in-part of application Ser. No. 10/120,201, filed Apr. 10, 2002, entitled "Apparatus and Method of Detecting Interfaces Between Well Fluids," incorporated herein in its entirety by reference.

BACKGROUND OF THE INVENTION

1. Field of the Invention

The invention relates to an apparatus and method for use in the field of oil and gas recovery. More particularly, this invention relates to a system having a first component, such as a detectable object or transponder, and a second component, such as sensor or sensor coil, adapted to determine when a device has passed a given point in the system.

2. Description of the Related Art

Cementing a wellbore is a common operation in the field of oil and gas recovery. Generally, once a wellbore has been drilled, a casing is inserted and cemented into the wellbore to seal off the annulus of the well and prevent the infiltration of water, among other things. A cement slurry is pumped down the casing and back up into the space or annulus between the casing and the wall of the wellbore. Once set, the cement slurry prevents fluid exchange between or among formation layers through which the wellbore passes and prevents gas from rising up the wellbore. This cementing process may be performed by circulating a cement slurry in a variety of ways, as described in parent U.S. patent application Ser. No. 10/120,201, entitled "Apparatus and Method of Detecting Interfaces Between Well Fluids," filed Apr. 10, 2002, by Robert Lee Dillenbeck and Bradley T. Carlson, attorney docket number 10286.0312.NPUS00, hereby incorporated herein in its entirety by reference.

Generally, in a conventional cementing operation, a cementing head is attached to the upper portion of the casing. A wiper plug is inserted into the cementing head. Liquid cement slurry is pumped down the cementing head forcing the wiper plug through the cementing head and into the casing. Once the desired amount of cement has been pumped inside the casing, another wiper plug, which had also been pre-inserted inside the cementing head, is released from the cementing head. A non-cementacious displacement fluid, such as drilling mud, is then pumped into the cementing head thus forcing the second wiper plug into the casing.

It is important to determine that each wiper plug has been properly "launched," i.e. that each wiper plug has left the cementing head. It is not uncommon for these wiper plugs to turn sideways and become lodged in the casing. If the plugs become lodged, excessive pressures may build up in the cementing head. Further, if the wiper plugs turn sideways, the cement may mix with the non-cementacious displacement fluid such as drilling mud. If this happens, the resulting cement may be contaminated to the point that a remedial cementing job may be required. Such remedial cementing jobs are time consuming, expensive and generally not as effective as a primary cementing job.

To determine if each wiper plug has been successfully launched, it is known to attach a wire to each wiper plug. The length of the wire corresponds to the length of the cementing head. As the wiper plug descends into the cementing head, the wire follows. Operators at the surface may visualize the movement of the wire which lets them know the wiper plug is moving down the cementing head. When the wiper plug enters the casing, the end of the wire enters the cementing head and no further wire is visible at the surface. Thus, in some applications, it is known to attach a piece of wire to the rubber wiper plug. However, this system requires an operator to monitor the wire at the surface. Further, this system is subject to defects because the wires may become accidentally separated from the wiper plug before the wiper plug reaches the casing. In this situation, the operator cannot ascertain whether the wire is loose or whether the wiper plug is lodged. Thus, there is a need for an apparatus and method for determining for certain that these wiper plugs have been properly launched.

Another common operation in well drilling and completion operations is the isolation of particular zones within the well. In some applications, such as cased-hole situations, conventional bridge plugs can be used. In other applications, it is possible to prevent the flow of fluids into the casing or to block off a particular zone in the well as follows. The casing will contain perforations in its walls at the horizontal level of a particular zone. The perforations are of known diameter. Sealing balls, having a diameter slightly larger than the perforations, are launched into the casing as follows. The sealing balls are loaded into a commercially available ball launcher or ball injector, such as the model GN201 or 202 by BN Machine Works of Calgary, Alberta. The ball injector periodically inserts a sealing ball into fluid flowing through an intermediate pipe to which the ball launcher is inserted. Once inserted into the intermediate pipe, the sealing balls travel through the conduit and finally are launched into the casing. The sealing balls then travel down the casing until the become lodged in the perforations.

As with the wiper plugs discussed above, occasionally the sealing balls will not properly launch. In some situations, the ball launcher or injector becomes jammed and the ball never leaves the injector. In other situations, an operator may fail to load any or a sufficient number of balls into the injector. In other situations, the injector may run out of balls. The result is that the operators erroneously believe the perforations are properly plugged and the desired zone is blocked off.

Prior art methods may also rely upon changes in pressure noticed at the surface to signal the arrival of the sealing balls in the perforations. However, these systems only signal the arrival of the sealing balls at the final destination; not the launch of the sealing balls. Thus, valuable time may elapse before it is realized that the sealing balls were improperly launched.

Thus, there is a need for a device that accurately verify that the sealing balls were properly launched from the ball injector.

SUMMARY OF THE INVENTION

The invention relates to a system and a method for detecting the launch of a device. In some embodiments, a system for detecting the launching of a device, is described having a first component disposed within the device, the device adapted to travel through a conduit and into wellbore, a first end of the conduit in fluid communication with an upper end of the wellbore. The system includes a second component, the first component and the second component adapted to be in communication with each other as the first component becomes substantially adjacent the second component thus detecting the launch of the device. The first component may be a sensor and the second component may be a detectable object, or the first component may be a detectable object and the second component may be a sensor.

The device being launched may be a wiper plug or a sealing ball. The the conduit may be connected to an upper end of a casing within the wellbore, and the second component is disposed substantially adjacent the first end of the conduit. In some embodiments, the sensor is a sensor could mounted within the outer diameter of the first end of the conduit. The detectable object may be a transponder adapted to send a Radio Frequency Identification signal to the sensor coil, the transponder modulating to send a unique identification number to the sensor coil. In other aspects, the transponder resonates at a frequency, the sensor coil being tuned to resonate at the frequency of the transponder. The frequency of the transponder may be 134.2 kHz. In some embodiments, the system may include host electronics in communication with the sensor coil, the host electronics displaying the unique identification number of the transponder.

In some embodiments, the device being launched is a sealing ball and the first end of the conduit is connected to the upper end of the wellbore by an intermediate pipe. The second component is disposed on the intermediate pipe. In some embodiments, the sensor further comprises a sensor coil adapted to be mountable within the inner diameter of the intermediate pipe. In others, the sensor further comprises a sensor coil adapted to be mountable around an outer perimeter of the intermediate pipe.

In some aspects, the detectable object is a transponder adapted to send a Radio Frequency Identification signal to the sensor coil. The transponder may modulate to send a unique identification number to the sensor coil, for instance at a frequency, the sensor coil being tuned to resonate at the frequency of the transponder. In some aspects, this frequency is 134.2 kHz. The system may include host electronics in communication with the sensor coil, the host electronics displaying the unique identification number of the transponder. The transponder may be implanted into the sealing ball.

Also described is a method of detecting the launching of a device, comprising providing the device with a first component; passing the device through a conduit, the conduit being in fluid communication with an upper end of a wellbore; providing a second component, the first and second components adapted to be in communication with each other as the second component is substantially adjacent the first component; and providing a signal from the first or second component to a host electronics package when the second component is substantially adjacent the first component, thus detecting the launch of the device. The method may further include providing a detectable object for the first component and providing a sensor for the second component.

In some aspects, the method includes providing a transponder for the detectable object and providing a sensor coil for the sensor. Also described is the step of providing a wiper plug with a transponder therein, a first end of the conduit being connected to an upper end of a casing within the wellbore, the sensor coil being adapted to be disposed on a perimeter of the first end of the conduit.

The step of passing the device through a conduit may include passing the wiper plug through a cement manifold, and pumping a fluid down the conduit behind the wiper plug to force the wiper plug into the casing. The method may include providing a sensor coil for the sensor and a transponder adapted to send a Radio Frequency Identification signal from the transponder to the sensor coil.

In some embodiments, the step of providing the device further comprises providing a sealing ball with a transponder therein, a first end of the conduit being connected to the upper end of the casing by an intermediate pipe, the sensor coil being adapted to be disposed on a perimeter of the intermediate pipe. In others, the step of passing the device through a conduit further comprises passing the sealing ball plug through a sealing ball injector.

Figure 1:
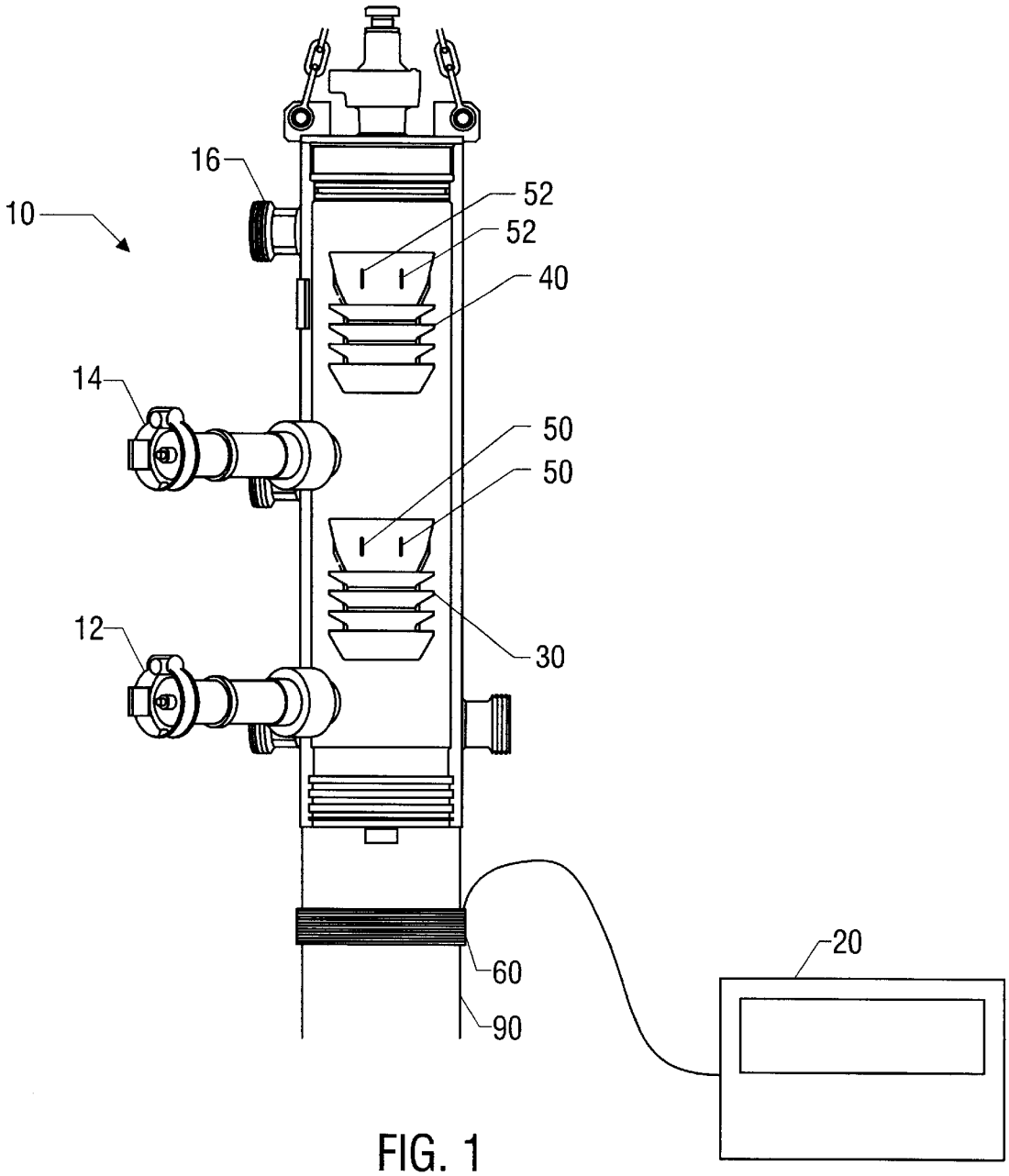
FIG. 1 shows one embodiment of the present invention prior to the launching a device, such as a wiper plug, into the well.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation. In the interest of clarity, not all features of an actual implementation are described in this specification. It will of course be appreciated that in the development of any such actual embodiment, numerous implementation-specific decisions must be made to achieve the developers' specific goals which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Embodiments of the invention will now be described with reference to the accompanying figures. Referring to FIG. 1, one embodiment of the present invention is shown being utilized with a cementing process. Devices, such as cement plugs or wiper plugs 30 and 40 are shown within a conduit, such as a cement manifold 10. Cement manifold 10 has a first end connected to casing 90 in wellbore 94 in this embodiment.

In some embodiments, the wiper plugs 30 and 40 may be molded from rubber. Within each wiper plug 30 and 40 are first components, such as transponders 50 and 52. Transponders 50 and 52 may be commercially available Radio Frequency Identification Devices ("RFID") such as those commercially available, from Texas Instruments, model P-7516, for example. Transponders 50 and 52 may be molded into the wiper plugs during manufacture. Or the RFID transponders 50 and 52 may be implanted into the wiper plugs by drilling a hole in the wiper plug, placing the transponder in the wiper plug, and then filling the hole with a rubber potting compound.

Shown adjacent the first end of the manifold is a second component, here a sensor such as sensor coil 60. This sensor coil 60 may be any commercially available sensor, such as that by Texas Instruments model RI-ANT-G01E, which operates as described hereinafter. Sensor coil 60 may be mounted on a perimeter of the first end of the cement manifold or mounted within an internal diameter of the cement manifold 10.

Sensor 60 is in electrical communication with host electronics package 20. Host electronics package may be any number of commercially available systems, such as that provided with the evaluation kit from Texas Instruments, model P-7620.

Cement manifold 10, or cementing head, is shown having three inlets: a lower inlet 12, a middle inlet 14, and an upper inlet 16.

In operation during a typical oilwell cementing operation, the wiper plugs 30 and 40 are loaded into the cementing head 10 as shown in FIG. 1. The fluid inlets 12, 14, and 16 are then opened and closed at the appropriate time as a fluid, such as cement or drilling mud, for example, is pumped into the well. Circulation of fluid through the appropriate inlet will launch the wiper plugs 30 and 40 into the casing in the wellbore.

Figure 2:
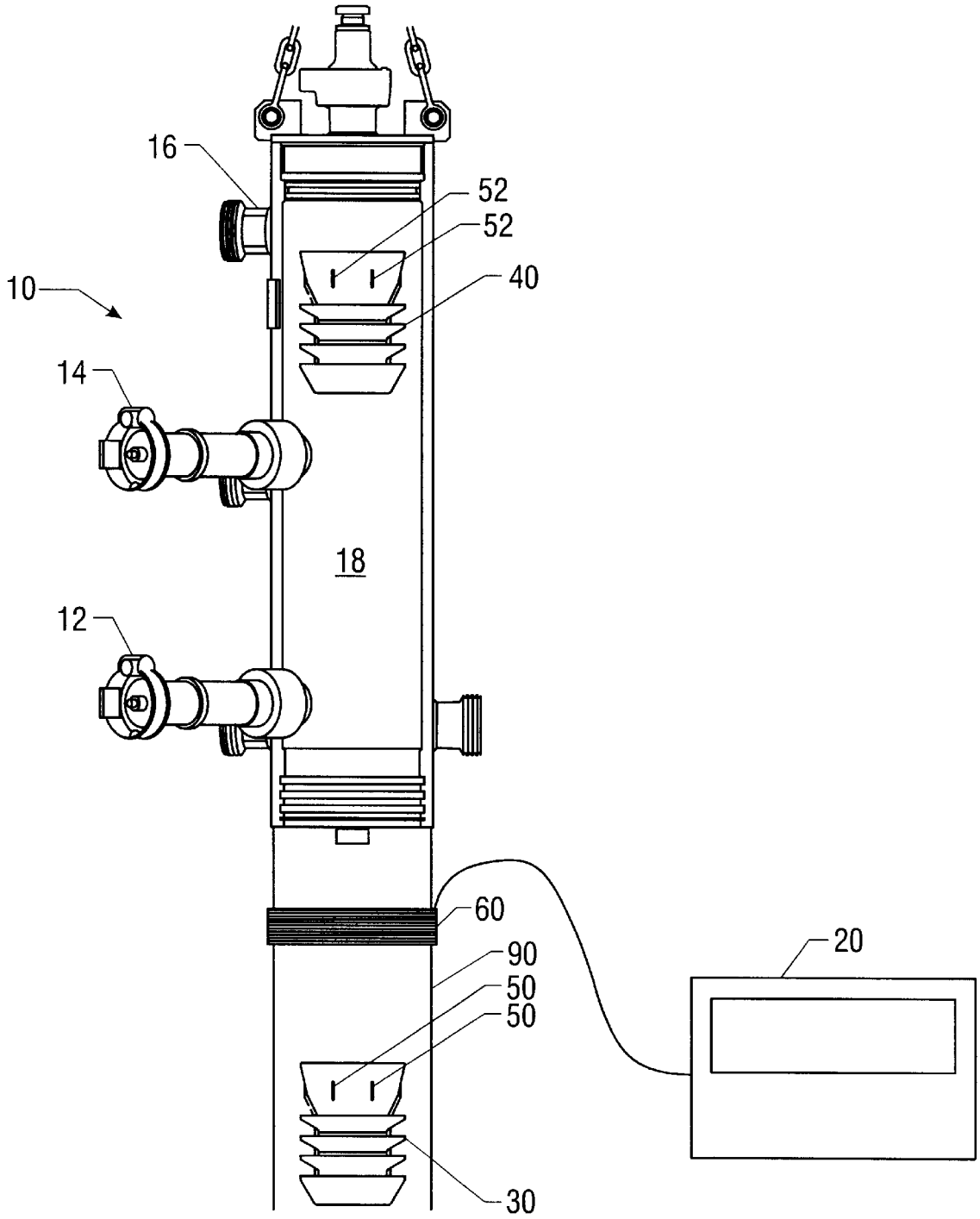
FIG. 2 shows one embodiment of the present invention in which one device, such as a wiper plug, is launched into the well.

For instance, typically the lower inlet 12 is opened to circulate the well with drilling fluid to condition the hole, such as removing excessive cuttings or cleaning up the wellbore. Once the wellbore is ready to be cementing, the lower inlet 12 is closed and cement is pumped though inlet 14. As shown in FIG. 2, cement slurry 18 forces first wiper plug 30 down out of the cement manifold and into the casing. As will be understood, first wiper plug 30 separates the drilling fluid below from the cement above and acts as a squeegee to clean the inner diameter of the cement manifold 10 as well as the casing 90 as it passes through each. Further, the wiper plug 30 preferably ensures the drilling mud does not mix with the cement.

Figure 3:
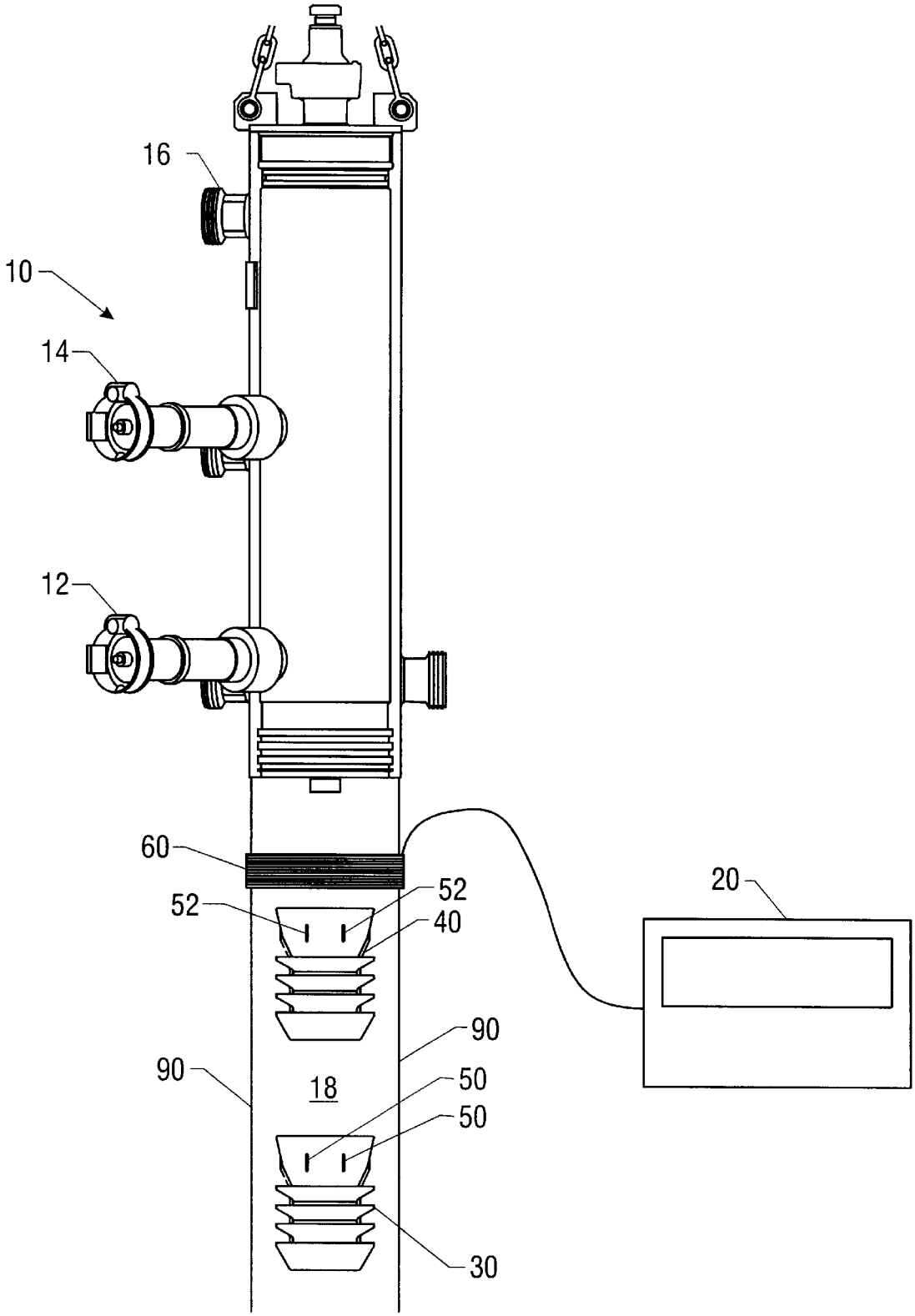
FIG. 3 shows an embodiment of the present invention in which a second device, such as a wiper plug, is launched into the well.

After a given amount of cement slurry has been pumped, the slurry must be displaced all the way down the wellbore and up into the annulus between the casing and wellbore. To perform this task, the middle inlet 14 is closed and a fluid such as drilling fluid and/or a spacer is pumped into upper inlet 16, which is opened. As shown in FIG. 3, this forces second wiper plug 40 down out of the cement manifold 10 and into casing 90.

In this embodiment of the present invention, in order to insure that each wiper plug 30 and 40 left the cementing head 10 and started into casing 90 of wellbore 94 (i.e. that each wiper head 30 and 40 has been successfully "launched"), this embodiment of the present invention detects the RFID transponders 50 and 52 embedded into wiper plugs 30 and 40 as each plug passes sensor coil 60.

Sensor coil 60 is tuned to resonate at a designed frequency corresponding to the RFID transponders 50 and 52. In this embodiment, the preferred frequency is 134.2 kHz. Sensor coil 60 may be integral to cementing head 10, mounted within or without the first end of cementing head 10, or it may be designed into a small coupling section of pipe installed below the cementing head 10.

The host electronics package 20 continually sends a signal for the sensing coil 60 to seek the RFID transponders 50 and 52. When the RFID transponders 50 and 52 pass near the sensor coil 60, each transponder 50 and 52 modulates the RF field sending a unique identification number that is stored in the RFID transponder back to the sensor 60 and to the host electronics 20. The host electronics package 20 may display this information locally or forward this information to a computer for logging and analysis.

In this way, the successful launch status of each wiper plug is monitored without intervention at the surface. Should the wiper plugs 30 and 40 turn sideways and become lodged, no signal will be generated by the transponders 50 and 52 being sensed by the sensor coil 60. This informs the operator of a problem.

Figure 4:
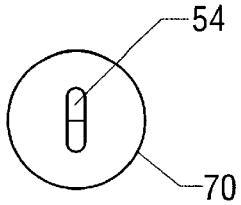
FIG. 4 shows a first component, such as a transponder, located within a device, such as a sealing ball, of one embodiment of the present invention.

Referring to FIG. 4, a device, such as a sealing ball 70, is shown having a first component, such as transponder 54. Transponder 54 may be any commercially-available unit, such as model number P-7516 available from Texas Instruments, which operate as detailed below. Sealing balls 70 are generally manufactured from rubber. Transponder 54 may be integrally molded within a sealing ball 70 during manufacture. Alternatively, the transponder 54 may be inserted into the sealing ball 70 after manufacture by drilling a hole in the sealing ball, imbedding the transponder 54 into the hold, and covering the hole with rubber potting compound, for instance.

Figure 5:
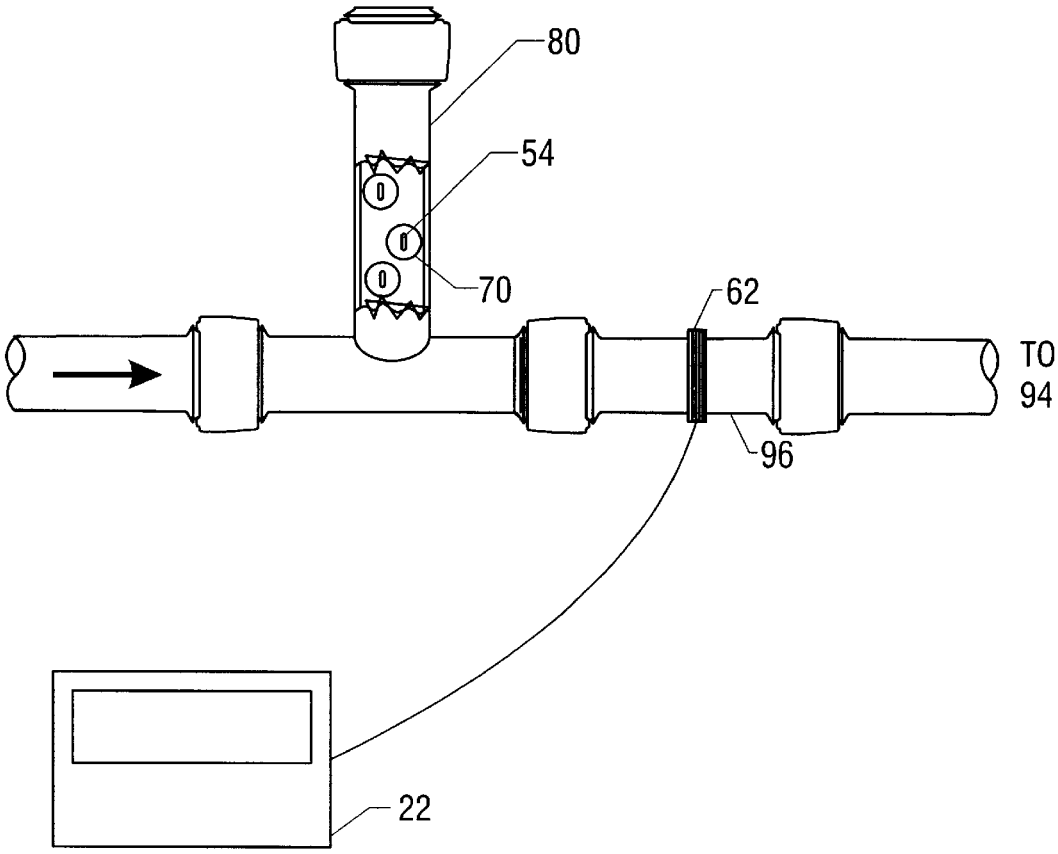
FIG. 5 shows an embodiment of the present invention that includes a ball injector, a first component such as detectable object or transponder, and a second component such as sensor or sensing coil.
Figure 6:
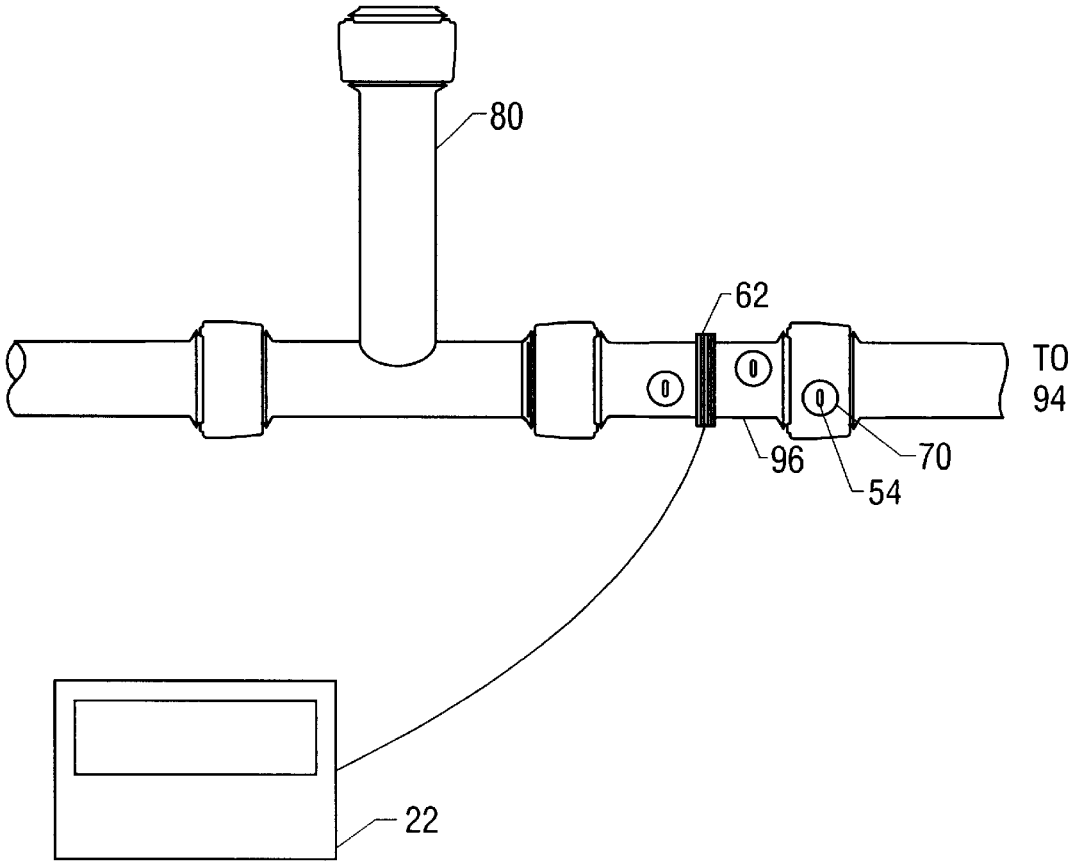
FIG. 6 shows an embodiment of the present invention in which a device, such as a sealing ball with a detectable object such as a transponder, has been launched.

As stated above, sealing balls are utilized in a typical oilwell process, as follows. Referring to FIG. 5, the sealing balls 70 are shown within a conduit, such as ball injector 80. In this embodiment, ball injector 80 is connected to wellbore 94—which may or may not have a casing within—via intermediate pipe 96. A fluid, such as cement, drilling mud, water, acid, fracturing fluid, or any other fluid, passes from frac pumps through the intermediate pipe 96 to the wellbore 94. In the embodiment shown in FIG. 5, the fluid flows from left to right.

A second component, shown in this embodiment as a sensor, or more particularly, sensor coil 62, may be disposed on intermediate pipe 96. Sensor coil 62 may be disposed on an outer perimeter of intermediate pipe 96, or sensor coil 62 could be mounted to an inner diameter of intermediate pipe 96, for example. Sensor coil 62 is electrically connected to a host electronics package 22. Sensor coil 62 may be any type of commercially available unit, such as model number RI-ANT-G01E from Texas Instruments, which operate as described herein.

During a typical oilwell stimulating treatment, the sealing balls 70 are loaded into the ball injector 80. The ball injector 80 releases the sealing balls 80, one at a time, into the fluid stream as the fluid is being pumped into the wellbore 94. In operation, the ball injector 80 releases a sealing ball 70 into the fluid flowing through the intermediate pipe 96.

To ensure that each sealing ball 70 has left the ball injector 80 and started toward the wellbore 94 that may have casing 90, the embodiment of the present invention detects the RFID transponders 54 embedded into the sealing balls 70 as the balls 70 and transponders 534 pass sensor coil 62.

In this embodiment, sensor coil 62 is tuned to resonate at a design frequency of the RFID transponders 54. In this application, the frequency is 134.2 kHz.

Sensor coil 62 continually sends a signal seeking the RFID transponders 54. When an RFID transponder 54 passes near sensor coil 62, the transponder 54 modulates the RF field sending unique identification numbers, which are stored in the RFID transponders, to the host electronics 22 through the sensor coil 62. The host electronics package 22 may display the identification numbers locally or forward the information to a computer for logging and analysis.

In this way, an operator performing may insure that the balls have been successfully launched. If a signal from a given transponder 54 is not detected by sensor coil 62 within a given period of time, the operator will know that there is a problem with the sealing ball 70 having that given transponder 54, such as the ball was not loaded into the ball injector, or the ball has become lodged.

Although various embodiments have been shown and described, the invention is not so limited and will be understood to include all such modifications and variations as would be apparent to one skilled in the art.

The following table lists the description and the numbers as used herein and in the drawings attached hereto.

| Item | Reference designator |
|---|---|
| Cement manifold/cementing head | 10 |
| Lower inlet | 12 |
| Middle inlet | 14 |
| Upper inlet | 16 |
| Cement slurry | 18 |
| Host electronics | 20 |
| Host electronics | 22 |
| Device, such as a cement plug or wiper plug | 30 |
| Second device, such as a cement plug or wiper plug | 40 |
| Component, such as a transponder in first cement plug or wiper plug | 50 |
| Component, such as a transponder in second cement plug or wiper plug | 52 |
| Component, such as a transponder in sealing ball | 54 |
| Component, such as a sensor | 60 |
| Component, such as a sensor coil | 62 |
| Device, such as a sealing ball | 70 |
| Conduit, such as a ball injector/launcher | 80 |
| Casing | 90 |
| Wellbore | 94 |
| Conduit, such as intermediate pipe or short pipe coupling | 96 |

What is claimed is:

1. A system for detecting the launching of a wiper plug into a wellbore, the system comprising:

a transponder implanted within the wiper plug, the wiper plug adapted to travel through a cement manifold and into a casing of a wellbore, the cement manifold in fluid communication with and connected to an upper end of the casing; and a sensor coil adapted to be mountable on an outer perimeter of the cement manifold, the transponder adapted to send a Radio Frequency Identification signal to the sensor coil as the transponder in the wiper plug becomes substantially adjacent the sensor coil, thus detecting the launch of the wiper plug.

2. A system for detecting the launching of a sealing ball, the system comprising:

a transponder implanted in the sealing ball, the transponder adapted to travel through a sealing ball injector and into a wellbore, the sealing ball injector and the wellbore being connected by an intermediate pipe having a fluid to carry the transponder therethrough; and a sensor coil adapted to be mountable around an outer perimeter of the intermediate pipe, the transponder adapted to send a Radio Frequency Identification signal to the sensor coil, the transducer and the sensor coil adapted to be in communication with each other as the transducer becomes substantially adjacent the sensor coil, thus detecting the launch of the transponder.

3. A system for detecting the launching of a device, the system comprising:

a first transponder disposed within the device, the device adapted to travel through a conduit and into a wellbore, the conduit in fluid communication with an upper end of the wellbore; and a sensor coil, the first transponder adapted to send a unique Radio Frequency Identification signal to the sensor coil as the transponder becomes substantially adjacent the sensor coil thus detecting the launch of the device as the device travels through the conduit to the wellbore.

4. The system of claim 3 in which the device is a wiper plug, a first end of the conduit is connected to an upper end of a casing disposed within the wellbore, and the sensor coil is disposed substantially adjacent the first end of the conduit.

5. The system of claim 4 in which the sensor coil is adapted to be mountable within the inner diameter of the first end of the conduit.

6. The system of claim 4 in which the sensor coil is adapted to be mountable around an outer perimeter of the first end of the conduit.

7. The system of claim 6 in which the transponder modulates to send a unique identification number to the sensor coil.

8. The system of claim 6 in which transponder resonates at a frequency, the sensor coil being tuned to resonate at the frequency of the transponder.

9. The system of claim 8 in which frequency of the first transponder is 134.2 kHz.

10. The system of claim 9 further comprising host electronics in communication with the sensor coil, the host electronics displaying the unique identification number of the first transponder.

11. The system of claim 7 in which the transponder is implanted into the wiper plug.

12. The system of claim 7 in which the transponder is molded into the wiper plug.

13. The system of claim 7 in which the transponder is inserted into the wiper plug.

14. The system of claim 7 in which the conduit is a cement manifold.

15. The system of claim 14 in which the cement manifold includes an inlet through which a fluid is inserted behind the wiper plug to drive the wiper plug into the casing.

16. The system of claim 15 further comprising:

a second transponder disposed within a second wiper plug, the second wiper plug adapted to travel through the conduit and into the casing, the second transponder adapted to send a second unique Radio Frequency Identification signal to the sensor coil as the second transponder becomes substantially adjacent the first end of the conduit thus detecting the launch of the second wiper plug, the Radio Frequency Identification signals sent by the first and second transponders each being unique to identify the wiper plug being launched.

17. The system of claim 3 in which the device is a sealing ball.

18. The system of claim 17 in which a first end of the conduit is connected to the upper end of the wellbore by an intermediate pipe.

19. The system of claim 18 in which the sensor coil is disposed on the intermediate pipe.

20. The system of claim 19 in which the sensor coil adapted to be mountable within the inner diameter of the intermediate pipe.

21. The system of claim 19 in which the sensor coil is adapted to be mountable around an outer perimeter of the intermediate pipe.

22. The system of claim 3 in which the transponder modulates to send a unique identification number to the sensor coil.

23. The system of claim 22 in which first transponder resonates at a frequency, the sensor coil being tuned to resonate at the frequency of the first transponder.

24. The system of claim 23 in which frequency of the first transponder is 134.2 kHz.

25. The system of claim 24 further comprising host electronics in communication with the sensor coil, the host electronics displaying the unique identification number of the first transponder.

26. The system of claim 17 in which the first transponder is implanted into the sealing ball.

27. The system of claim 17 in which the first transponder is molded into the sealing ball.

28. The system of claim 17 in which the first transponder is inserted into the sealing ball.

29. The system of claim 24 further comprising a host electronics package, the host electronics package adapted to continually send a signal seeking the first transponder.

30. The system of claim 18 in which the conduit is a sealing ball injector.

31. The system of claim 30 in which the intermediate pipe contains a fluid which carries the sealing ball therethrough.

32. The method of claim 30 further comprising:

a second transponder disposed within a second sealing ball, the second sealing ball adapted to travel through the conduit and into the casing, the second transponder adapted to send a second unique Radio Frequency Identifiation signal to the sensor coil when the second sealing ball become substantially adjacent the first end of the conduit, thus detecting the launch of the second sealing ball, the Radio Frequency Identification signals sent by the first and second transponders each being unique to identify the sealing ball being launched.

33. A system for determining the launching of a device, the system comprising:

a transponder being located in the device, the device adapted to travel through a conduit and into a wellbore, the conduit in fluid communication with an upper end of the wellbore;

and a means for sensing the transponder when the transponder becomes substantially adjacent the means for sensing.

34. The system of claim 33 in which the device is a wiper plug, a first end of the conduit is connected to an upper end of a casing disposed within the wellbore, and the means for sensing is disposed substantially adjacent the first end of the conduit.

35. The system of claim 33 in which the device is a sealing ball, the first end of the conduit is connected to the upper end of the wellbore by an intermediate pipe, and the means for sensing is disposed on the intermediate pipe.

36. The system of claim 34 or 35 further comprising a controlling means, said controlling means adapted to receive a signal from the means for sensing.

37. A method of detecting the launching of a device into a wellbore, comprising:

providing each of the plurality of devices with a transponder;

passing each of the plurality of devices through a conduit, the conduit being in fluid communication with an upper end of the wellbore;

providing a sensing coil each transponder adapted to send a unique Radio Frequency Identification signal to the sensor coil as the transponder is substantially adjacent the sensor coil; and providing a unique signal from the sensor coil to a host electronics package when each transponder is substantially adjacent the sensor coil, thus detecting the launch one of the plurality of devices.

38. The method of 37 in which the step of providing the pluraluity of devices further comprises providing a plurality of wiper plugs, each having one of the plurality of transponders therein, a first end of the conduit being connected to an upper end of a casing disposed within the wellbore, the sensor coil being adapted to be disposed on a perimeter of the first end of the conudit.

39. The method of claim 38 in which the step of passing the device through the conduit further passing one of the plurality of wiper plugs through a cement manifold.

40. The method of claim 39 further comprising:

pumping a fluid down the conduit behind one of the wiper plugs to force the wiper plug into the casing.

41. The method of 37 in which the step of providing the plurality of devices further comprises providing a plurality of sealing balls, each with one of the plurality of trasnsponders therein, a first end of the conduit being connected to the upper end of the wellbore by an intermediate pipe, the sensor coil being adapted to be disposed on a perimeter of the intermediate pipe.

42. The method of claim 41 in which the step of passing the device through the conduit further comprises passing one of the pluralities of the sealing balls through a sealing ball injector.

43. The method of claim 42 further comprising:

pumping a fluid through the intermediate pipe behind the plurality of sealing balls to force the sealing balls into the wellbore.

44. A system for detecting the launching of a plurality of wiper plugs into a wellbore, the system comprising:

a plurality of transponders, each of the plurality of transponders being implanted within one of the plurality of wiper plugs, each of the plurality of wiper plugs adapted to travel through a cement manifold and into a casing of a wellbore, the cement manifold in fluid communication with and connected to an upper end of the casing; and a sensor coil adapted to be mountable on an outer perimeter of the cement manifold, each of the plurality of transponders adapted to send a unique Radio Frequency Identification signal to the sensor coil as each of the plurality of transponders in each of the plurality of wiper plugs becomes substantially adjacent the sensor coil, thus detecting the launch of each of the plurality of wiper plugs.

45. A system for detecting the launching of a plurality of sealing balls, the system comprising:

a plurality of transponders, each transponder being implanted in one of the plurality of sealing balls, the transponder adapted to travel through a sealing ball injector and into a wellbore, the sealing ball injector and the wellbore being connected by an intermediate pipe having a fluid to carry the transponder therethrough; and a sensor coil adapted to be mountable around an outer perimeter of the intermediate pipe, the transponder adapted to send a Radio Frequency Identification signal to the sensor coil, the transponder and the sensor coil adapted to be in communication with each other as the transponder becomes substantially adjacent the sensor coil, thus detecting the launch each of one of the plurality of sealing balls having one of the transponders.

* * * * *